US006963315B2

(12) United States Patent
Gierow et al.

(10) Patent No.: US 6,963,315 B2
(45) Date of Patent: Nov. 8, 2005

(54) INFLATABLE ANTENNA

(75) Inventors: Paul Gierow, Madison, AL (US); Gregory P. Laue, Huntsville, AL (US); William R. Clayton, Huntsville, AL (US); Ronald D. Hackett, Fayetteville, TN (US)

(73) Assignee: SRS Technologies, Inc., Huntsville, AL (US)

( * ) Notice: Subject to any disclaimer, the term of this patent is extended or adjusted under 35 U.S.C. 154(b) by 0 days.

(21) Appl. No.: 10/429,442

(22) Filed: May 5, 2003

(65) Prior Publication Data

US 2004/0222938 A1 Nov. 11, 2004

(51) Int. Cl.[7] ..... H01Q 15/20
(52) U.S. Cl. ..... 343/872; 343/881; 343/915
(58) Field of Search ..... 343/912, 915, 343/880, 872, 881, 840; 342/8, 10

(56) References Cited

U.S. PATENT DOCUMENTS

| | | | | |
|---|---|---|---|---|
| 3,587,098 A | | 6/1971 | Gosnell | |
| 3,715,759 A | | 2/1973 | Esposito et al. | |
| 3,957,228 A | | 5/1976 | Kennedy, Jr. | |
| 4,482,333 A | | 11/1984 | Geri et al. | |
| 4,673,934 A | | 6/1987 | Gentry et al. | |
| 4,768,739 A | | 9/1988 | Schnee | |
| 4,901,081 A | | 2/1990 | Bain, Jr. et al. | |
| 4,980,688 A | | 12/1990 | Dozier, Jr. | |
| 4,996,536 A | | 2/1991 | Broadhurst | |
| 5,017,925 A | | 5/1991 | Bertiger et al. | |
| 5,132,699 A | * | 7/1992 | Rupp et al. | 343/880 |
| 5,166,696 A | * | 11/1992 | Rupp et al. | 343/711 |
| 5,386,953 A | | 2/1995 | Stuart | |
| 5,597,335 A | | 1/1997 | Woodland | |
| 5,641,135 A | | 6/1997 | Stuart et al. | |
| 5,986,619 A | | 11/1999 | Grybos et al. | |
| 6,115,003 A | | 9/2000 | Kozakoff | |
| 6,167,924 B1 | | 1/2001 | Buckley et al. | |
| 6,168,116 B1 | | 1/2001 | Renshall et al. | |
| 6,300,893 B1 | | 10/2001 | Schaff et al. | |
| 6,650,304 B2 | * | 11/2003 | Lee et al. | 343/915 |

FOREIGN PATENT DOCUMENTS

WO WO 00/57685 A3 10/2000

OTHER PUBLICATIONS

SPACENEWS, Army Awards $24 Million Satellite Terminals Contract to L3 Apr. 21, 2003, p. 13.
Stuart Luman, Air Ball Wired Apr. 2003. 051.

* cited by examiner

*Primary Examiner*—Michael C. Wimer
(74) *Attorney, Agent, or Firm*—David E. Mixon; Bradley Arant Rose & White, LLP

(57) ABSTRACT

The invention is an inflatable antenna system. The antenna system includes an inflatable lenticular dish. The dish is enclosed in an inflatable radome. The inflatable radome stabilizes the orientation of the dish and protects it from environment conditions such as wind.

18 Claims, 18 Drawing Sheets

99

INFLATABLE ANTENNA

BACKGROUND OF THE INVENTION

1. Field of the Invention

The invention relates generally to an antenna. More specifically, the present invention relates to an inflatable antenna that is stabilized with a radome.

2. Background Art

Antennas tend to be very sensitive elements of communications or radar systems. Correct alignment of the dish portion of the antenna is critical to proper operation. However, a large antenna dish can become unstable when exposed to environmental conditions such as wind. Typical solutions involve bracing and reinforcing the antenna system with a heavy support structure. While this approach works for fixed location antennas, it is difficult to implement for portable antennas. FIG. 1 shows an example of a prior art deployable satellite communications antenna 10. The satellite dish 12 is braced by heavy beams 14 in order to keep the entire antenna properly aligned. The amount of weight and storage space required by such an antenna system is an impediment to quick and easy movement and assembly in locations that need satellite communications. Other solutions include using an antenna with a smaller dish size. While smaller antennas are more portable, their performance is not as good as that of larger antennas. Antenna performance characteristics such as the signal-to-noise ratio are dependent on the size and parabolic curvature of the antenna dish. Typically, a larger dish has better performance.

Light weight inflatable antennas have been demonstrated for use on orbital satellites. These inflatable antennas are large in size and have excellent performance characteristics. Since they are used in space, they are not subject to environmental conditions such as wind that can affect their alignment. However, because of the structural weakness resulting from their light weight, they are typically unsuitable for atmospheric use. Consequently, a need exists for a ground based inflatable antenna that is both stable and portable.

SUMMARY OF INVENTION

In some aspects, the invention relates to an antenna, comprising:

an inflatable dish; and an inflatable radome that surrounds the dish, where the radome stabilizes the orientation of the dish.

In other aspects, the invention relates to a phased-array antenna, comprising: at least one array of multiple radiator panels, where the panels are folded with off-set, self-aligning hinges; and an inflatable radome that surrounds the array, where the radome stabilizes the orientation of the array.

In other aspects, the invention relates to a phased-array antenna, comprising: an array of multiple radiator panels; an inflatable, cylindrical-shaped radome that surrounds the array, where the radome stabilizes the orientation of the array; and where the radiator panels are attached to the interior of the radome with multiple catenaries.

In other aspects, the invention relates to a phased-array antenna, comprising: an array of multiple radiator panels, where the panels are folded with off-set, self-aligning hinges; and a support frame that stabilizes the orientation of the array.

In other aspects, the invention relates to an antenna, comprising: a log periodic array antenna; and an inflatable radome that surrounds the log periodic array antenna, where the radome stabilizes the orientation of the log periodic array antenna.

In other aspects, the invention relates to an antenna, comprising: means for transmitting and receiving signals; and means for stabilizing the means for transmitting and receiving signals.

Other aspects and advantages of the invention will be apparent from the following description and the appended claims.

BRIEF DESCRIPTION OF DRAWINGS

It should be noted that identical features in different drawings are shown with the same reference numeral.

DETAILED DESCRIPTION

Figure 1:
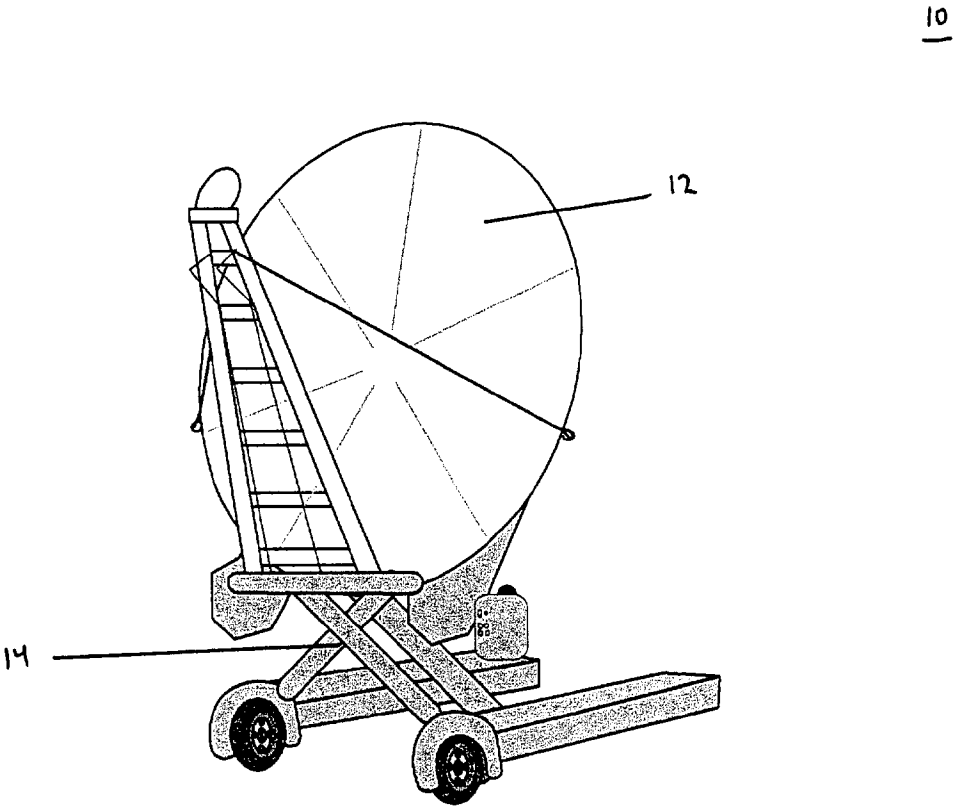
Figure 1 Prior Art
FIG. 1 shows a view of a prior art deployable satellite communications antenna.
Figure 2A:
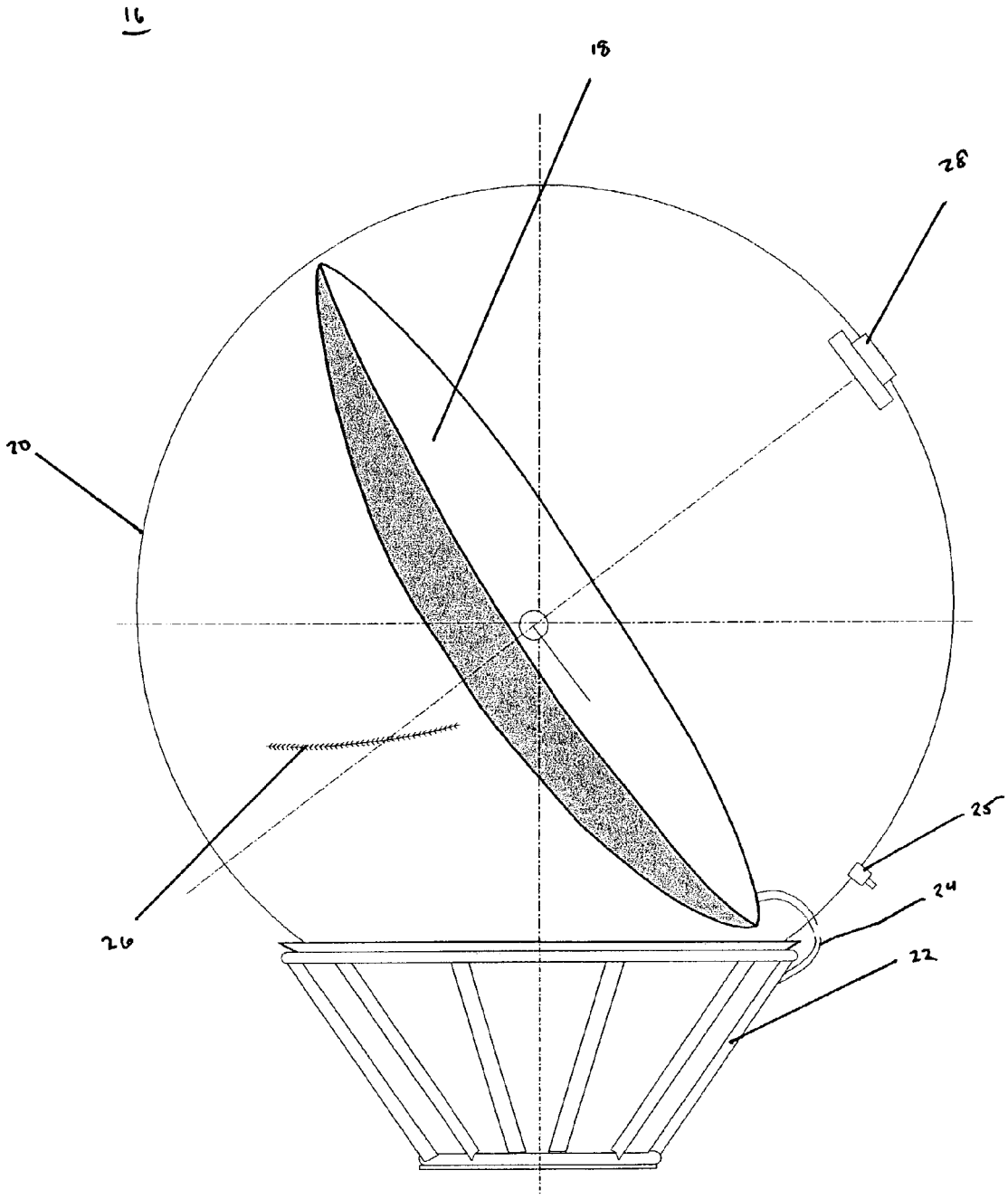
FIG. 2*a* shows a cross-section view of a ground based inflatable antenna in accordance with one embodiment of the present invention.

A ground-based inflatable antenna that may be used as part of a portable satellite communications system has been developed. The antenna may also be used for other applications such as radar or line-of-sight communications. FIG. 2*a* shows a cross-section view of an example of an antenna 16 in accordance with one embodiment of the present invention. The antenna includes an inflatable lenticular or "dish" 18 that is oriented towards a target such as a satellite. The dish 18 is surrounded by an inflatable radome 20. The radome 20 is a spherical-shaped cover that provides protection for the dish 18 from environmental elements such as wind, etc. This allows the dish 18 to maintain proper alignment towards its target. The radome 20 is constructed of a flexible material or a membrane that is stable in ultraviolet light. A membrane is a thin, pliable sheet of natural or synthetic material that is supported by either mechanical tension or a pressure differential. The material should not interfere with the signals being generated or received by the antenna. Observation windows (not shown) made of clear material such as vinyl may be included on the surface of the radome 20 to allow visual inspection of the internal area of the antenna.

Figure 3B:
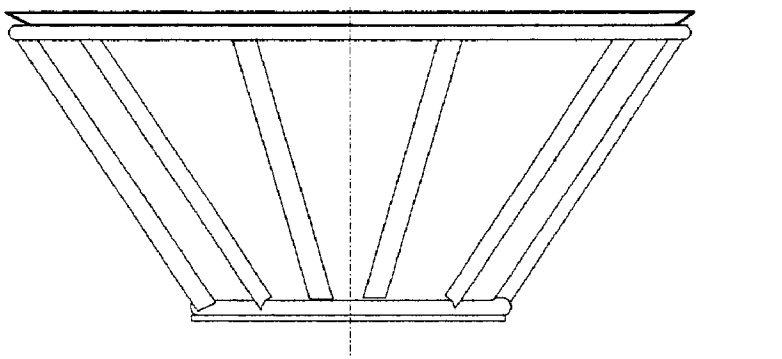
FIGS. 3*a* and 3*b* show an overhead and side view of a support cradle for the antenna shown in FIG. 2 in accordance with one embodiment of the present invention.
Figure 3A:
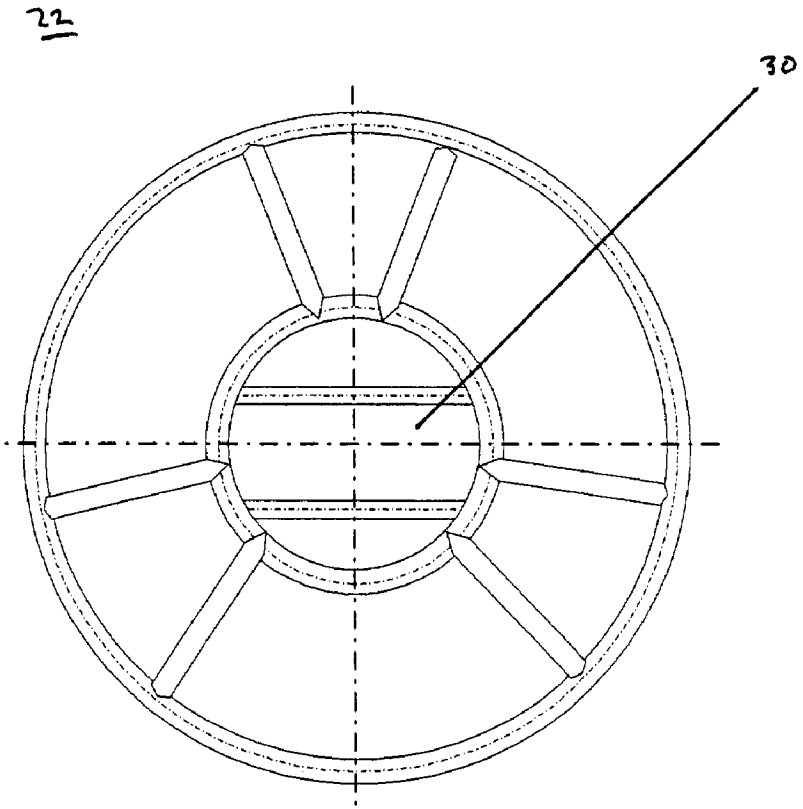

The radome 20 is supported by a cradle 22 that holds the antenna in position. The cradle 22 may attached to additional base structures such as a vehicle top or trailer. FIGS. 3*a* and 3*b* show respectively an overhead view and a side view of an example of a cradle 22. The inter-connections from the antenna 16 to the other components of the system are made through an opening 30 in the bottom of cradle 22.

Returning to FIG. 2*a*, access to the interior of the radome 20 is available through a port 26. In this embodiment, the port is sealed with a zipper. The inflation and deflation of the antenna is controlled with an inflation tube 24 and an egress valve 25 respectively. A feed horn 28 for the dish 18 is located on the exterior of the radome 20. It is supported entirely by the surface of the inflated radome without any additional structure. The dimensions of the radome are configured such that the feed horn is located at the focal point of the dish 18. This configuration of the feed horn 28 with the dish 18 is called an "on-axis" or "prime focus" alignment. In alternative embodiments, other configurations of the feed and dish may be used such as: an offset alignment; a folded alignment (including both Gregorian and Cassegrain arrangements); and a hybrid of the offset and folded alignments.

Figure 2B:
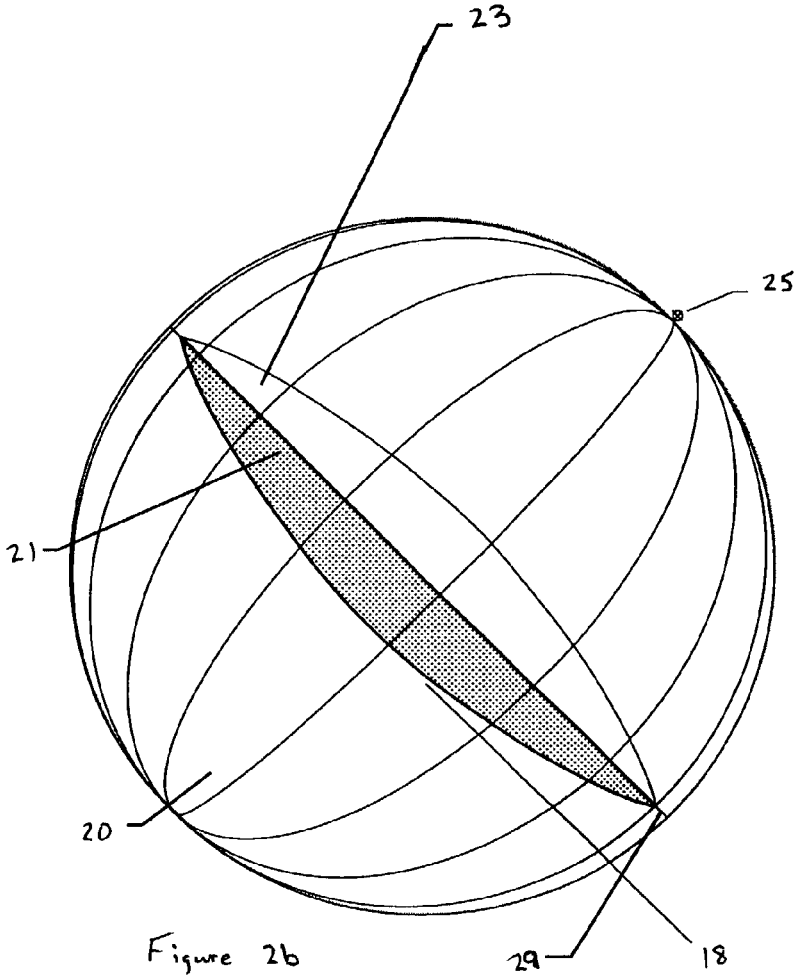
FIG. 2*b* shows an alternative cross-section view of a ground based inflatable antenna in accordance with one embodiment of the present invention.
Figure 2C:
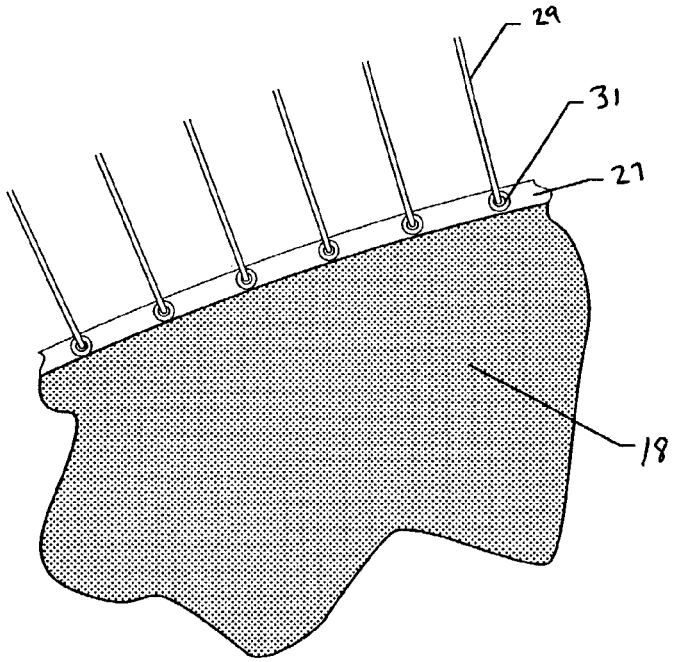
FIG. 2*c* shows a view of catenary connections for a lenticular dish in accordance with one embodiment of the present invention.

The dish 18 may be constructed of two complementary, doubly-curved membranes. In FIG. 2*b*, the dish 18 is shown with a parabolic curved reflector membrane 21 and an RF-transparent parabolic canopy 23. The concave sides of the membranes are joined at a bond band 27 to form a convex-shaped structure that is called the lenticular dish 18. As shown in FIG. 2*c*, the lenticular dish 18 is held in place when the radome 20 is inflated by a series of catenaries 29 that are connected to the bond band 27 with grommets 31.

Figure 4A:
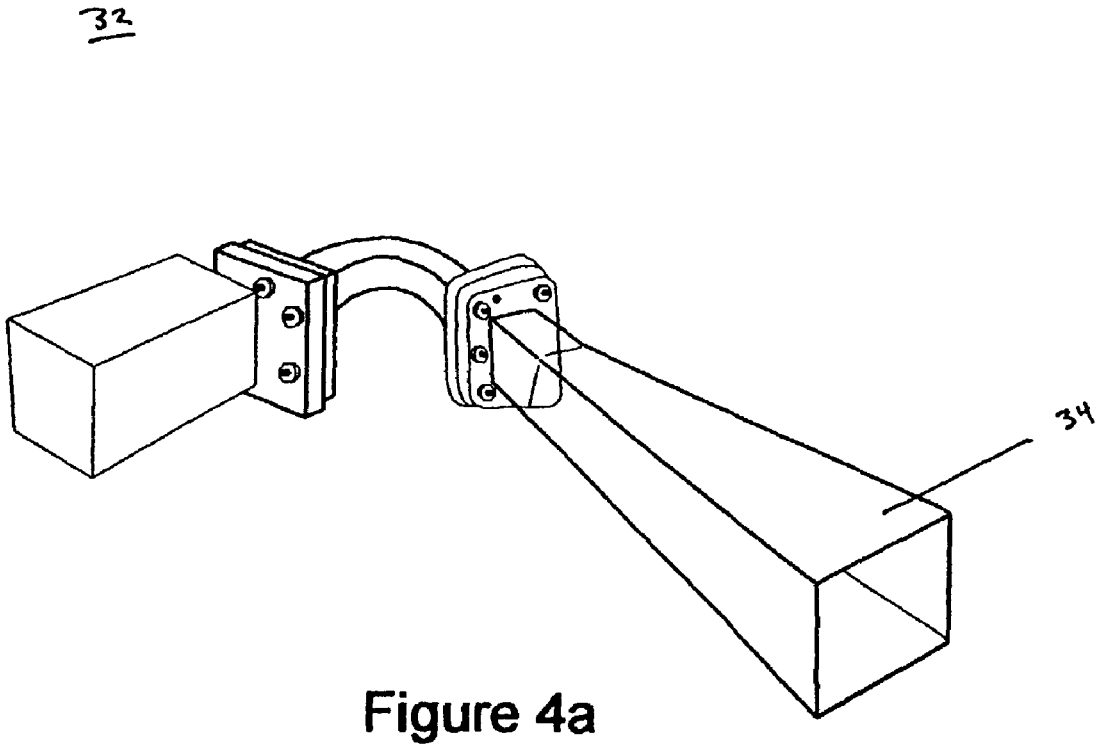
FIG. 4*a* shows a view of a standard feed horn used in accordance with one embodiment of the present invention.
Figure 4B:
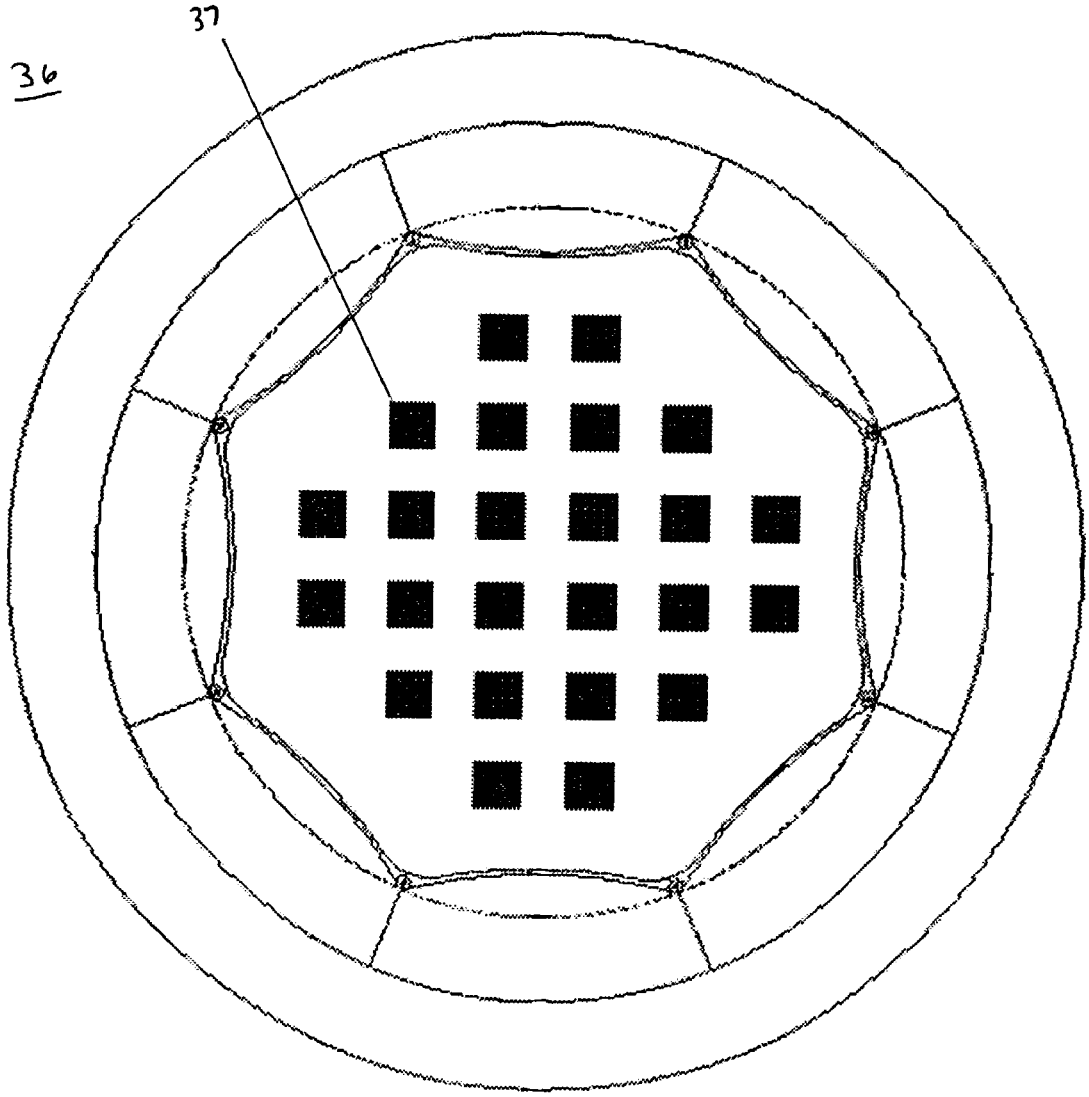
FIG. 4*b* shows a view of an array feed used in accordance with an alternative embodiment of the present invention.

FIGS. 4*a* and 4*b* show two examples of types of feeds that may be used with the present invention. FIG. 4*a* shows a radio frequency (RF) feed horn with a 90° bend 32. Other embodiments may use different configurations and angles for a feed horn. The feed horn is mounted on the radome so that the opening 34 in the pyramid-shaped base faces down towards the dish of the antenna. FIG. 4*b* shows an array feed 36 that also may be mounted on the radome. The array feed 36 contains a series of identical elements 37 which can be used to form multiple signal beams or to electrically steer the antenna.

Figure 5:
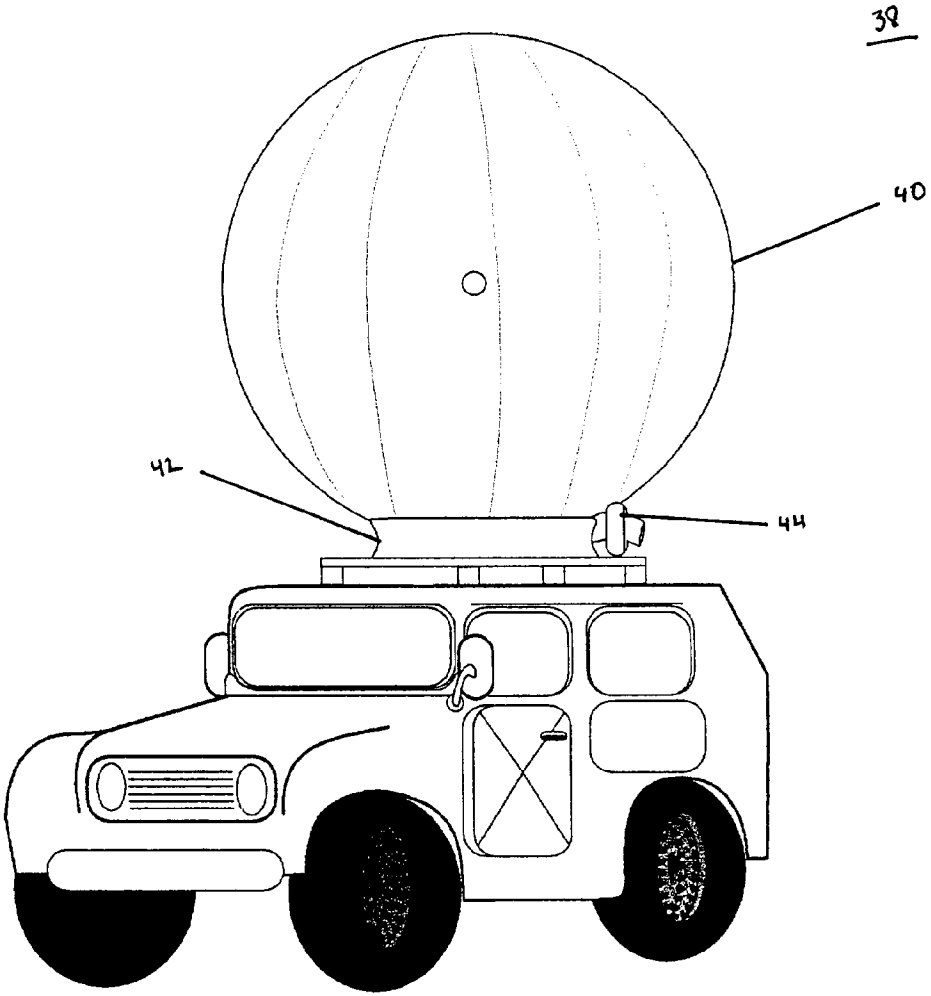
FIG. 5 shows a view of a vehicle with a fully deployed inflatable antenna and radome in accordance with one embodiment of the present invention.

FIG. 5 shows an example of an inflatable antenna mounted on the top of a vehicle 38. A cradle 42 is used to connect the radome 40 to the top of the vehicle. The antenna is inflated through a connection 44 in the side of the cradle 42. A blower (not shown) is attached to the connection to provide a continuous flow of air to the antenna. In this example, the air flow from the blower should be continuous to the antenna in order to compensate for leakage of air from the radome through the material, zipper, observation panels, etc. The remaining components of the communication system are located in the vehicle and are connected to the antenna through the cradle 42.

Figure 6C:
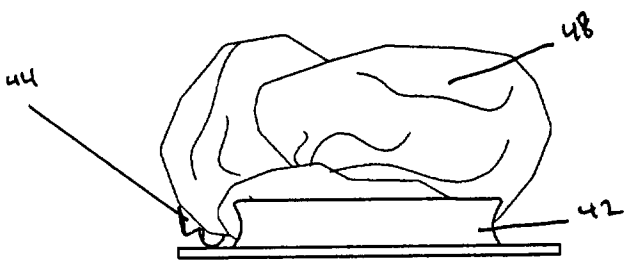
FIGS. 6*a*, 6*b*, and 6*c* show progressive steps of deploying an inflatable antenna in accordance with one embodiment of the present invention.
Figure 6B:
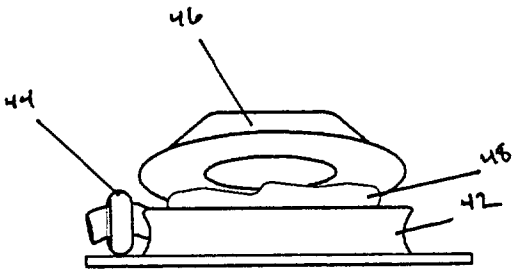
Figure 6A:
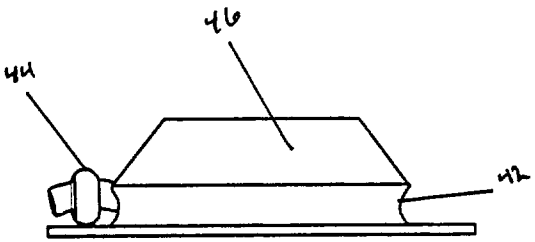

FIGS. 6*a*, 6*b*, and 6*c* show an example of how the antenna is carried and inflated. FIG. 6*a* shows a deflated antenna that is stowed away for easy transportation. The cradle 42 is attached to the top of a vehicle as previously shown in FIG. 5. The cradle 42 and its cover 46 contain the collapsed deflated antenna. As shown FIG. 6*b*, once the vehicle arrives at its destination, a blower (not shown) is attached to the connection 44 on the side of the cradle 42 and the cover 46 is opened. As shown in FIG. 6*c*, once the blower is turned on, the antenna 48 begins to inflate. The inflation continues until the antenna is fully deployed. Once inflated, the air pressure inside the radome should be maintained to ensure mechanical stability of the antenna over vibration, wind gusts, gravity, etc.

The internal air pressure is typically maintained by a continuous air flow from the attached blower to compensate for leakage. However, if the radome is less prone to leakage, intermittent use of the blower could be used to periodically re-pressurize the antenna. The amount of internal air pressure is dependent on the expected amount of force to be exerted on the antenna. Such forces primarily include wind but also may include the weight of the horn that is supported by the radome. For example, an internal air pressure of about 0.1 pounds per square inch, gauge (PSIG) is sufficient to withstand the load of winds of 30 miles per hour (MPH) on a 5-meter diameter radome. Higher internal pressures may be used to withstand loads from higher winds. Additionally, the antenna may be secured by supplemental guy lines called "tethers" that attach to the exterior of the radome and are tied to a stable structure such as the vehicle or an in-ground stake. In an alternative embodiment, the exterior of the radome could be coated with a resin that would harden and cure when exposed to sunlight. This embodiment would typically not be re-stowed once it had been initially deployed and consequently would become a semi-permanent antenna.

Figure 7A:
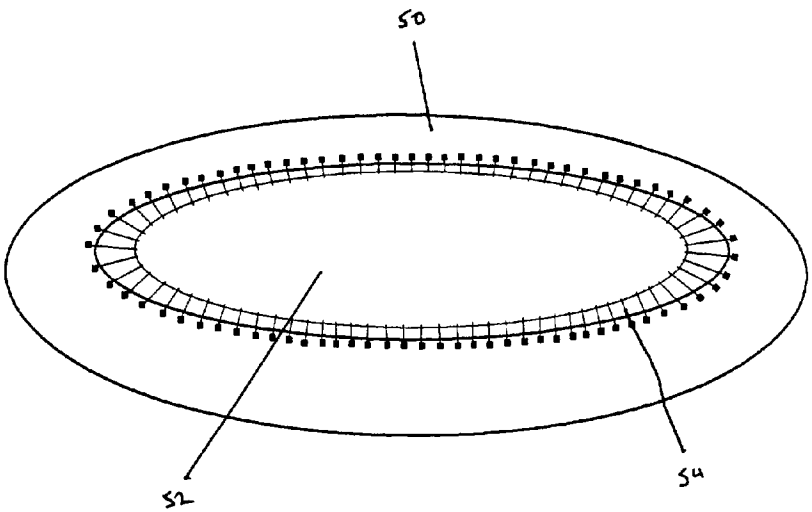
FIGS. 7*a* and 7*b* show an inflatable torus and lenticular used with an antenna in accordance with one embodiment of the present invention.
Figure 7B:
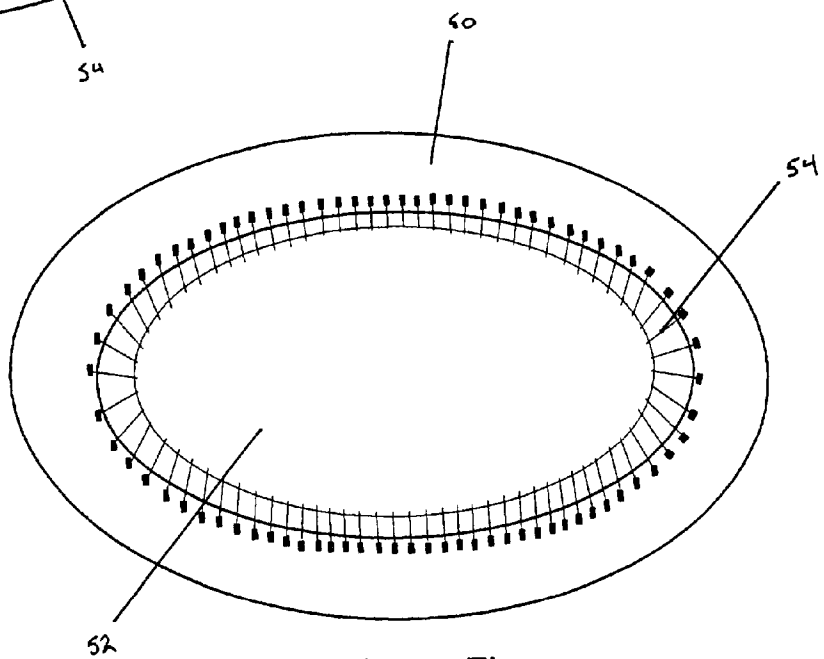

FIGS. 7*a* and 7*b* show a perspective and frontal view respectively of an example of an inflatable torus 50 and lenticular or "dish" 52 used with the antenna. The torus 50 is an inflatable ring that fits within and is attached to the interior of the radome of the antenna. In alternative embodiments, the antenna could be used without the radome by securing it with separate support struts such as ground tethers, etc. When it is fully inflated and expanded, the torus 50 holds the dish 52 in place with a series of catenaries 54. These catenaries are attached to both the torus 50 and the dish 52 with grommets. The size and parabolic arc of the dish is designed so that its focal point should be on the surface of the radome. The focal point will be where the feed is located. It is important to note that the dimensions of antennas will vary widely in different embodiments. However in the present example, the antenna has a diameter of 196 inches. The internal dish has a diameter of 189 inches (4.8 meters) with a focal length of about 120 inches and is supported from the spherical radome by a series of elastic retainers.

The lenticular dish may be formed by seaming two parabolic membranes together. One membrane is microwave-reflective and the other is non-reflective. The membranes may be made of light weight, thin polymers. The microwave-reflective composition of the dish of the antenna may be either a heterogeneous material or a homogenous material. The reflective membrane may be rendered reflective by coating it with metallizing paint. In one embodiment, metallizing paint is a heterogeneous material that includes silver metallic flake in an epoxy binder. In other embodiments, other conductive materials such as a homogeneous thin layer of aluminum or other microwave reflective materials could be used as a reflective coating. The non-reflective membrane is uncoated and transparent to RF signals. The membranes that make up the dish are about 1.00–1.25 mils thick. The heterogeneous reflective metallic coating for one of the membranes is about 100,000 Angstroms thick. Homogenous reflective coatings for the reflective membrane may be between 1,000–2,000 Angstroms thick.

Figure 8:
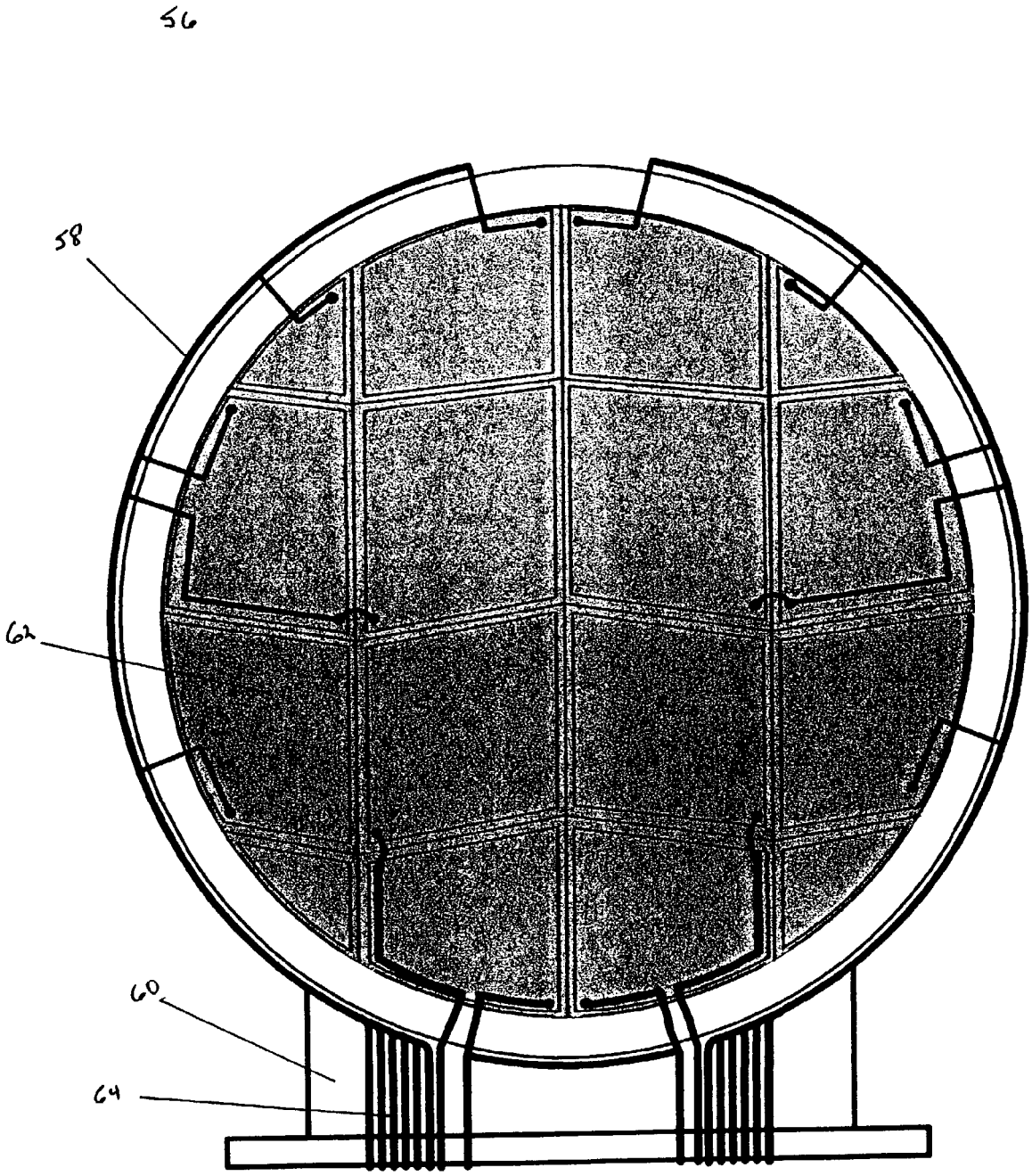
FIG. 8 shows a deployed phased-array radar panel used in accordance with one embodiment of the present invention.

FIG. 8 shows cross-section view of an alternative embodiment of the present invention that uses a phased array antenna 56. A phased array antenna uses an array of identical radiators with the capability of altering the phase of the power fed to each of them. This allows the shape and direction of the radiation pattern to be altered without mechanical adjustment of the antenna. In FIG. 8, the phased array antenna 56 has sixteen separate antenna panels 62. Each panel 62 contains an array of smaller antennas or radiators. The antenna panels 62 are surrounded by a radome 58 in a similar manner as described in previous examples. The antenna is supported by a cradle 60 that may be attached to a supporting structure (not shown). Each panel 62 has a connection 64 with the other components of the system (not shown) through the interior of the cradle 60.

Figure 9:
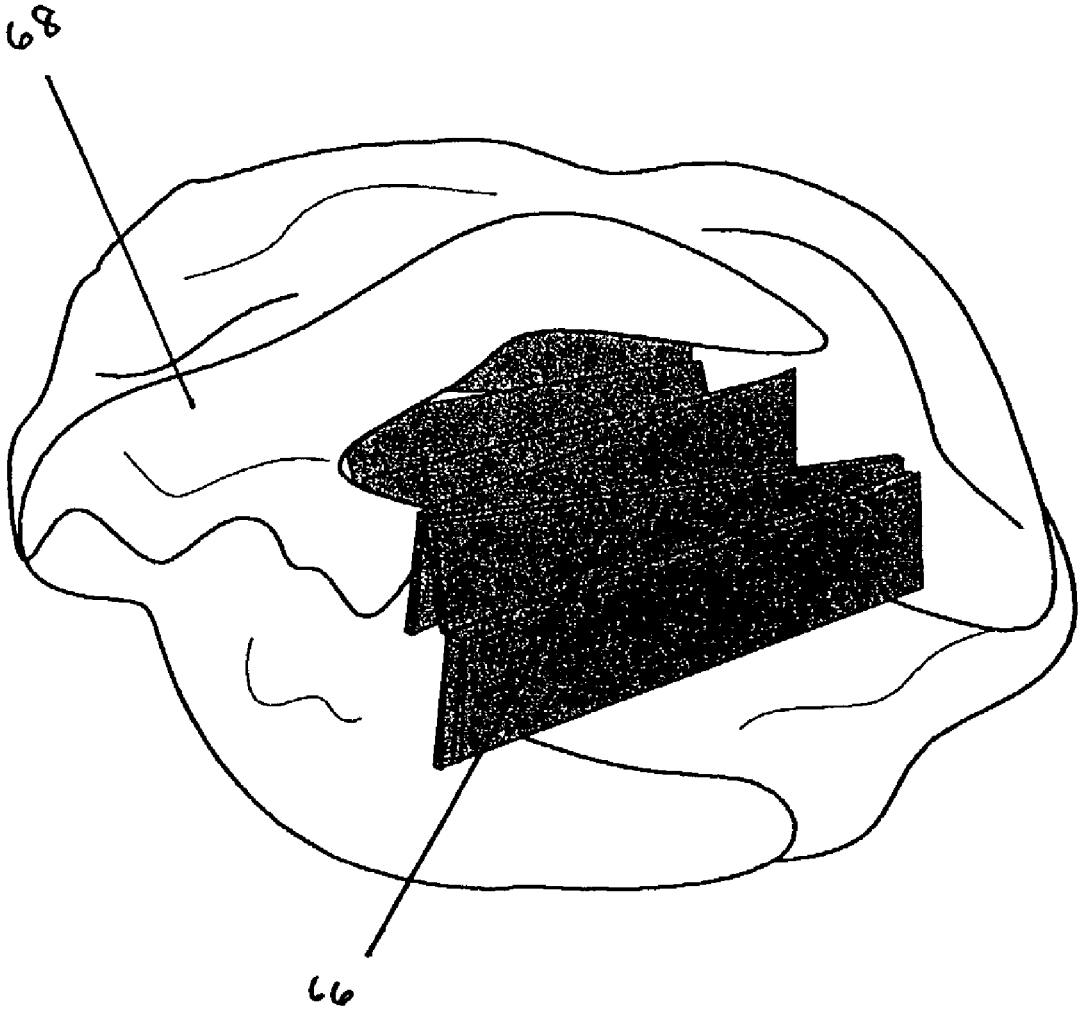
FIG. 9 shows a deploying phased-array radar panel with radome in accordance with one embodiment of the present invention.
Figure 10:
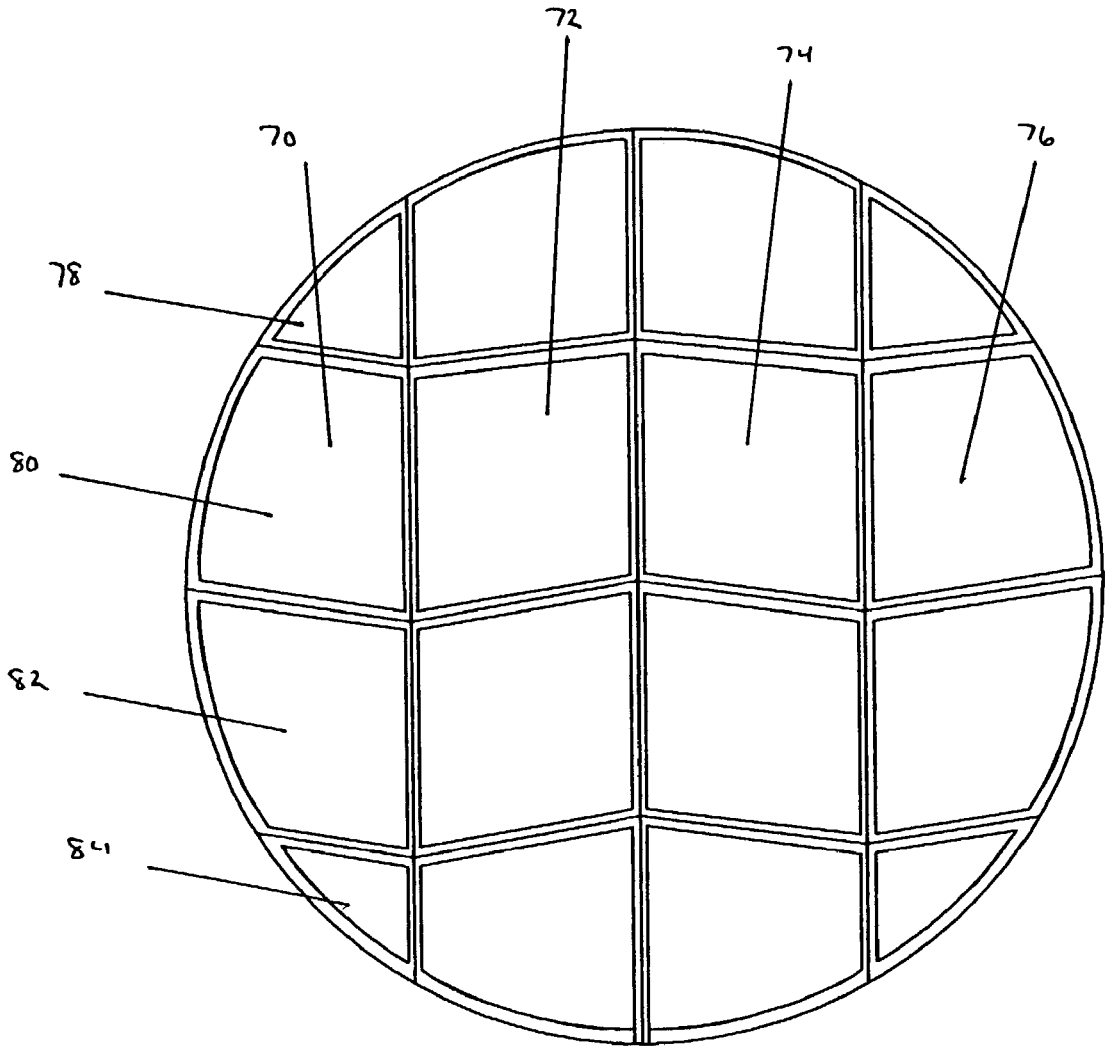
FIG. 10 shows a deployable phased-array radar panel used in accordance with one embodiment of the present invention.

The panels 62 are made of a light weight, rigid material and they are connected with each other with a series of off-set, self-aligning hinges. This configuration allows for the panels to fold up when being stowed away. FIG. 9 shows a cut-away view of the antenna panels 66 being folded up inside the deflated radome 68. As shown in FIG. 10, the antenna panels are arranged in four separate columns 70, 72, 74, and 76 and four rows in each column 78, 80, 82 and 84. When the antenna is stowed, the columns and rows all fold simultaneously with each other. The twelve panels on the exterior edge of the antenna are connected to the interior of the radome by flexible cords. As the radome inflates, these cords pull the panels apart from their folded configuration. Once the radome is fully deployed, the panels are fully extended into a single panel. The off-set, self-aligning hinges are used to compensate for the thickness of the individual panels.

Figure 11:
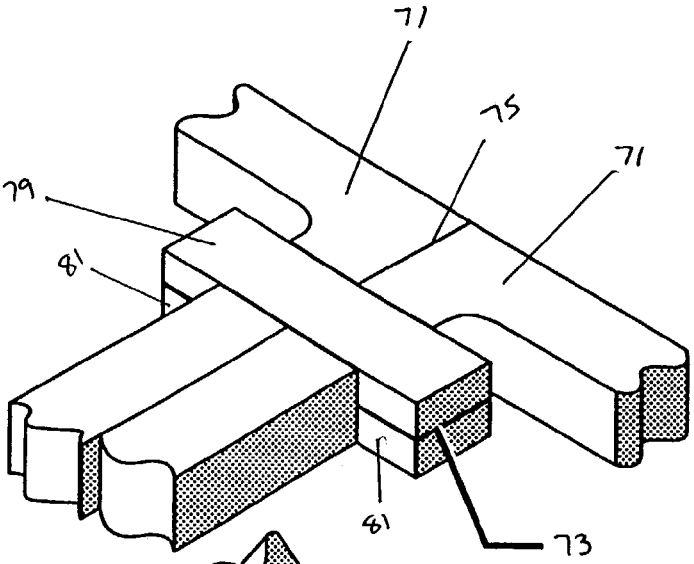
FIG. 11 shows two panels of a deployed phased-array antenna with self-aligning offset hinges in accordance with one embodiment of the present invention.

FIG. 11 shows two panels 71 of a deployed phased-array antenna with an off-set, self-aligning hinge 73. The hinge allows the panels of the antenna to fold in an "Origami-style" technique. This means that the panels 71 fold and unfold simultaneously when force is applied instead of being able to fold or unfold one column or row at a time. The origami folding technique ensures that all of the panels of the antenna will fully deploy when the antenna is unfolded. Likewise, all of the panels of the antenna will fully fold up when the antenna is packed up.

Figure 12A:
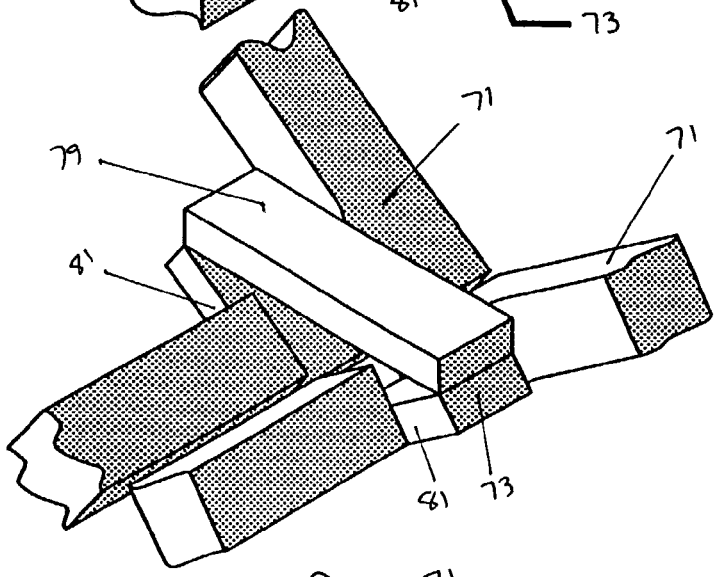
FIGS. 12*a* and 12*b* show two partially unfolded panels of a phased-array antenna with self-aligning offset hinges in accordance with one embodiment of the present invention.
Figure 12B:
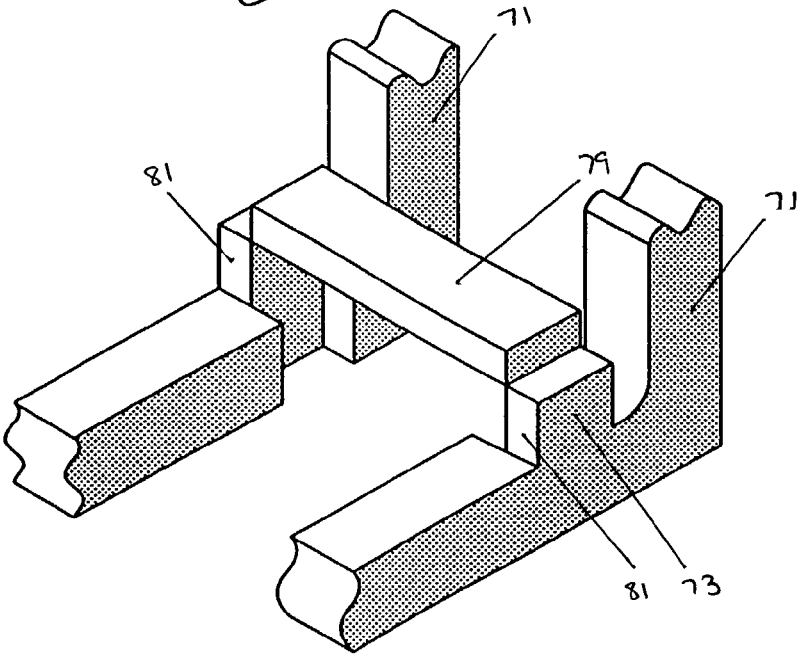

FIGS. 12*a* and 12*b* show two partially folded panels of a phased-array antenna with off-set, self-aligning hinges. An electrical connector (not shown) is located on the edges of the body of the panels 71. It is used to make an electrical connection between the panels 71. The connector may be a spring contact connector for direct current (DC) connections or a capacitive coupled co-axial connector for radio frequency (RF) connections. Other types of connectors that are known in the art could be used in alternative embodiments. The self-aligning hinge 73 is shown with a cross member 79 that spans across the seam 75 of the two panels 71. The cross member 79 connects to each panel by cantilever struts 81 with a pivoting or flexing-membrane hinge. Each folding connector 81 is attached to its respective panel 71. When the panels are fully deployed, the cantilever struts 81 fold underneath the cross member 79 and the entire hinge 73 seats flush across the seam 75 of the panels 71 in a recessed slot. When the panels are unfolded, the cantilever struts 81 fold out from under the cross member 79 and allow the panels 71 to move.

Figure 13B:
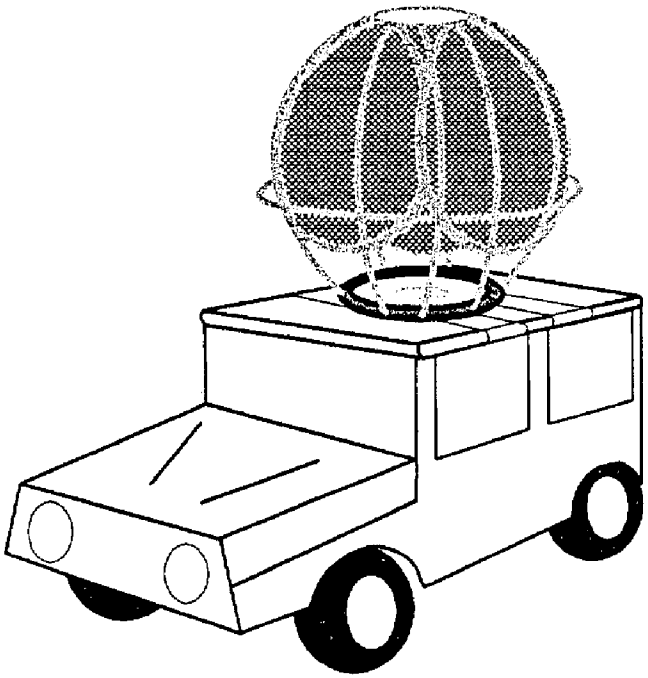
FIG. 13*b* shows a cut away view of a vehicle with triple phased-array radar panels and radome in accordance with one embodiment of the present invention.
Figure 13A:
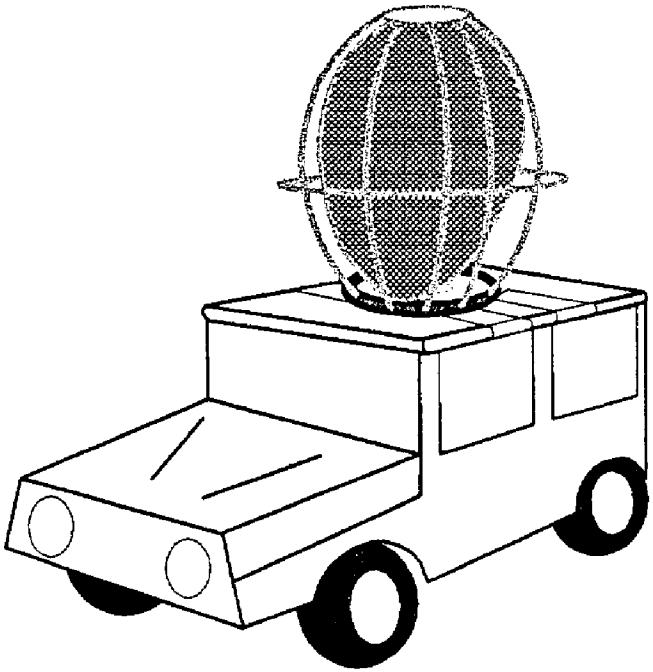
FIG. 13*a* shows a cut away view of a vehicle with a single phased-array radar panel and radome in accordance with one embodiment of the present invention.

FIGS. 13*a* and 13*b* show cut away views of alternative embodiments of deployed phased array antennas. FIG. 13*a* shows a fully deployed single plane phased array antenna 86 that is mounted on the top of a vehicle. FIG. 13*b* shows a fully deployed triple plane phased array antenna 88 that is also mounted on top of a vehicle. In this embodiment, three identical phased array antennas are configured at an angle of 120° with respect to each other. This arrangement provides full 360° coverage without having to re-orient the antenna's direction. Alternative embodiments could use varying numbers of panels that are equidistantly angled for 360° coverage. For example, four panels could be used that are arranged at a 90° angle with respect to each other.

Figure 14B:
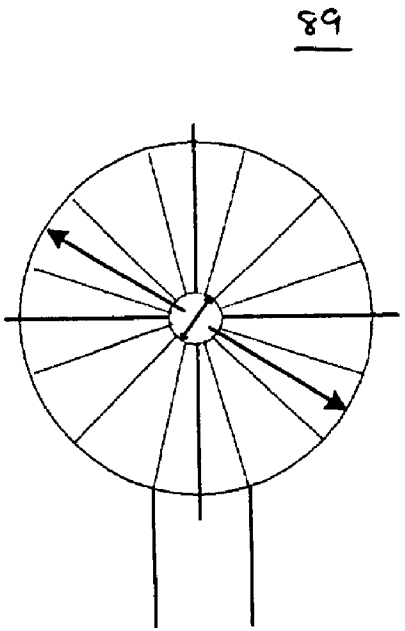
FIGS. 14*a* and 14*b* show an alternative embodiment of a single phased-array array antenna panel and radome.
Figure 14A:
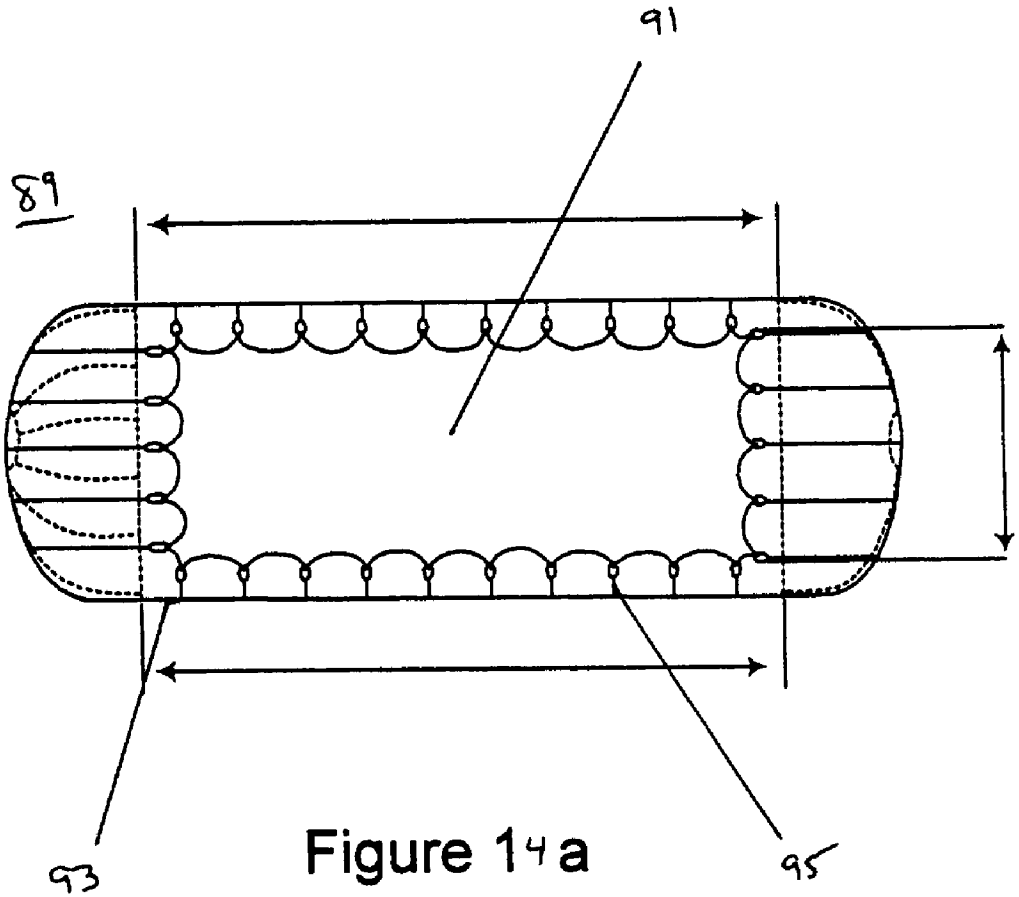

FIGS. 14*a* and 14*b* show cross sectional views of another embodiment of a deployed phased array antenna. In this embodiment, the antenna 89 is cylindrically shaped. The radome 93 is an inflatable elongated cylinder with dome-shaped cap on each end. The antenna panels 91 are suspended in the radome 93 with multiple flexible centenaries 95. This embodiment of an inflatable antenna may be deployed on the back of a trailer or fixed on the ground with guy lines to hold it in position.

Figure 15A:
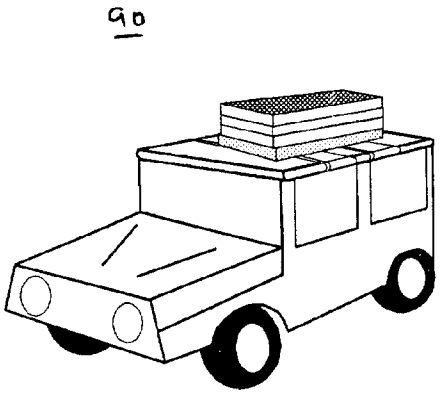
FIGS. 15*a*, 15*b*, and 15*c* show an alternative embodiment single panel phased-radar panel being extended on top of a vehicle.
Figure 15B:
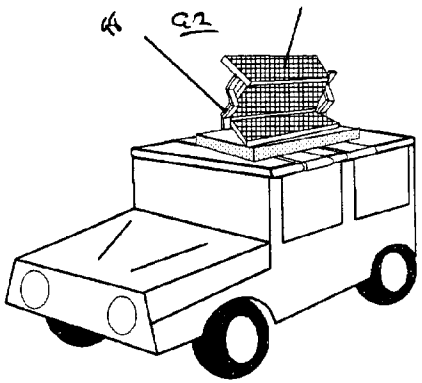
Figure 15C:
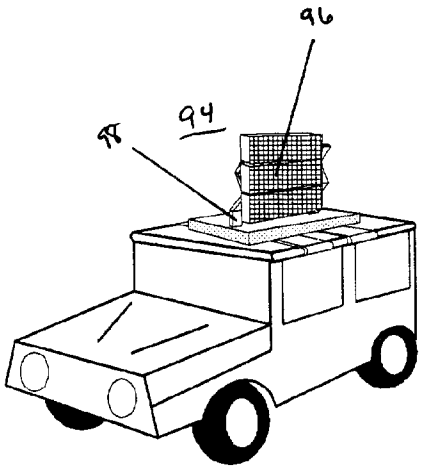

FIGS. 15*a*, 15*b* and 15*c* show an alternative embodiment of a phased array antenna being deployed. In this embodiment, the phased array antenna panels are not surrounded by a radome, but instead they are held in place with a support frame. The antenna may use the off-set, self-aligning hinges described previously. FIG. 15*a* shows the phased array antenna in a stowed configuration 90 on top of a vehicle. As shown in FIG. 15*b*, once the vehicle arrives on station, the panels of the antenna 96 are deployed by extending the support frame 98. FIG. 15*b* shows the antenna 94 fully extended and braced by the support frame 98. The antenna may also be retracted and stowed in a similar manner. In alternative embodiments, the antenna could be mounted on a rotating base so that the orientation may be changed without moving the vehicle. In other embodiments, the antenna could have multiple phased array panels to provide 360° coverage as previous shown and described in FIG. 13*b*.

Figure 16:
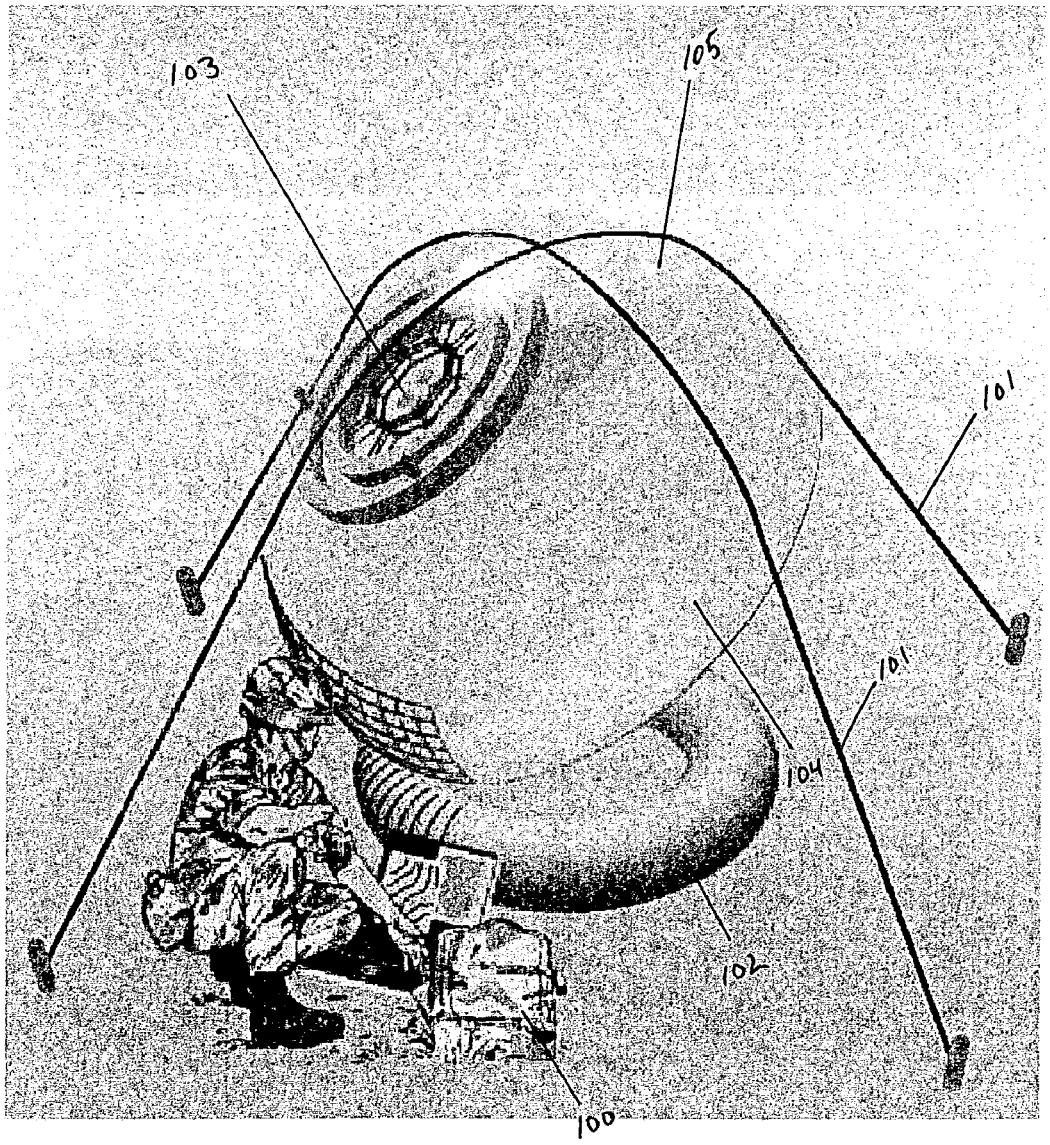
FIG. 16 shows a man-portable antenna in accordance with one embodiment of the present invention.

In alternative embodiments, the present invention could be deployed in a man-portable configuration. FIG. 16 shows a man-portable antenna 99 that is carried in a backpack 100 and tethered to the ground 101 when deployed. In this embodiment, the antenna is supported on an inflatable torus 102 and uses an array feed 103 with the inflatable lenticular

104 inside a spherical radome 105. Alternatively, the radome of the antenna could be filled with helium, etc. and lifted in the air. Ground tethers would be used to secure the antenna to the ground. In other embodiments, the present invention could be used on aeronautical vehicles such as blimps or other types of aircraft as well as orbital satellites.

Figure 17A:
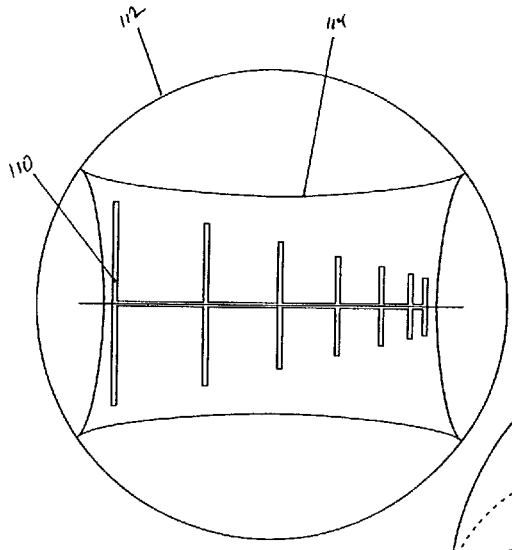
FIGS. 17*a*, 17*b*, and 17*c* show an alternative embodiment of the present invention that uses a log-periodic antenna and a radome.
Figure 17C:
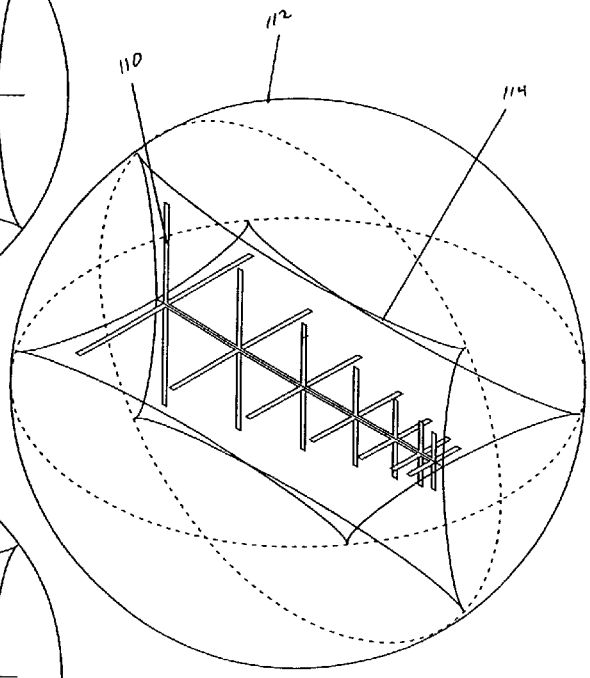
Figure 17B:
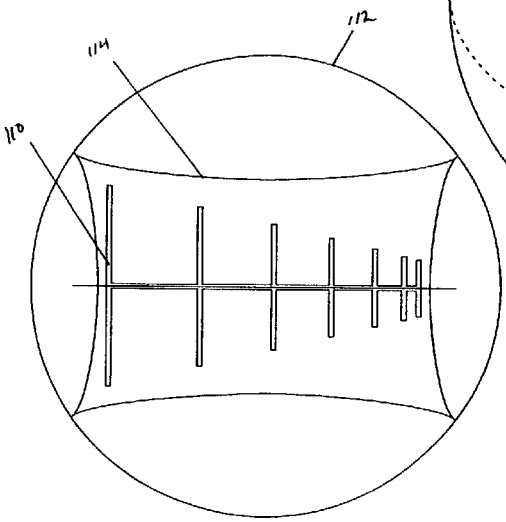

FIGS. 17*a*–17*c* show an alternative embodiment of the present invention that uses a log-periodic antenna. FIGS. 17*a* and 17*b* show a top view and a front view of the antenna respectively. FIG. 17*c* shows a perspective view of the embodiment. This antenna contains a cross-polarized, log periodic array (LPA) antenna 110 that is inside an inflatable radome 112. The LPA 110 could be printed elements on membranes 114 as shown. In alternative embodiments, the LPA 110 could be wire antennas that are held in place and supported by non-conducting catenaries. In other embodiments, multiple LPA 110 could be mounted inside one radome 112.

The present invention has the advantages of being a light weight, transportable antenna for ground based use. Both the inflatable reflector and foldable phased array antennas offer significant improvements in weight and stowage space used over conventional antennas. While the invention has been described with respect to a limited number of embodiments, those skilled in the art, having benefit of this disclosure, will appreciate that other embodiments can be devised which do not depart from the scope of the invention as disclosed here. Accordingly, the scope of the invention should be limited only by the attached claims.

What is claimed is:

1. An antenna, comprising:

an inflatable dish;

an inflatable radome that surrounds the dish, where the radome stabilizes the orientation of the dish;

a window that allows observation of the interior of the radome; and a port that allows access to the interior of the radome.

2. The antenna of claim 1, where the port is opened and closed with a zipper.

3. An antenna, comprising:

an inflatable dish;

an inflatable radome that surrounds the dish, where the radome stabilizes the orientation of the dish; and a feed that is mounted on the surface of the radome.

4. The antenna of claim 3, where the feed is an RF feed horn.

5. The antenna of claim 3, where the feed is an array feed.

6. The antenna of claim 3, where the dish and radome are inflated with an external blower.

7. The antenna of claim 6, where blower generates a continuous air flow.

8. The antenna of claim 3, where the dish comprises a first membrane and a second membrane.

9. The antenna of claim 8, where the first membrane is coated with a conductive material and the second membrane is transparent to RF signals.

10. The antenna of claim 9, where the conductive material is a metallized paint comprising silver flakes.

11. The antenna of claim 3, further comprising:

an inflatable torus that is attached to the interior of the radome, where the torus holds the dish in proper orientation.

12. The antenna of claim 3, where the radome is coated with a resin that cures to harden the radome.

13. The antenna of claim 3, where the antenna is further stabilized by guy lines that attach the exterior of the radome to a fixed structure.

14. A phased-array antenna, comprising:

at least one array of multiple radiator panels, where the panels are folded with off-set, self-aligning hinges comprising a cross member and a cantilever strut that attaches the cross member to a radiator panel; and an inflatable radome that surrounds the array, where the radome stabilizes the orientation of the array.

15. The antenna of claim 13, further comprising multiple separate panels of arrays of multiple radiator panels, where the panels are oriented at angles to provide 360 degrees of coverage.

16. The antenna of claim 13, further comprising three separate panels of arrays of multiple radiator panels, where the panels are oriented at a 120 degree angle with respect to each panel.

17. A phased-array antenna, comprising:

an array of multiple radiator panels;

an inflatable, cylindrical-shaped radome that surrounds the array, where the radome stabilizes the orientation of the array; and where the radiator panels are attached to the interior of the radome with multiple catenaries.

18. A phased-array antenna, comprising:

an array of multiple radiator panels, where the panels are folded with off-set, self-aligning hinges comprising a cross member and a cantilever strut that attaches the cross member to the array of multiple radiator panels; and a support frame that stabilizes the orientation of the array.

* * * * *

UNITED STATES PATENT AND TRADEMARK OFFICE

CERTIFICATE OF CORRECTION

PATENT NO. : 6,963,315 B2
APPLICATION NO. : 10/429442
DATED : May 5, 2003
INVENTOR(S) : Paul Gierow et al.

It is certified that error appears in the above-identified patent and that said Letters Patent is hereby corrected as shown below:

Column 1, before the section titled "BACKGROUND OF THE INVENTION", insert the following:
-- STATEMENT REGARDING FEDERALLY SPONSORED RESEARCH OR DEVELOPMENT The U.S. Government has a paid-up license in this invention and the right in limited circumstances to require the patent owner to license others on reasonable terms as provided for by the terms of Contract No. F33615-02-C-5011 awarded by the United States Department of the Air Force. --

Signed and Sealed this

Sixth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 6,963,315 B2
APPLICATION NO. : 10/429442
DATED : November 8, 2005
INVENTOR(S) : Paul Gierow et al.

It is certified that error appears in the above-identified patent and that said Letters Patent is hereby corrected as shown below:

Column 1, before the section titled "BACKGROUND OF THE INVENTION", insert the following:
-- STATEMENT REGARDING FEDERALLY SPONSORED RESEARCH OR DEVELOPMENT The U.S. Government has a paid-up license in this invention and the right in limited circumstances to require the patent owner to license others on reasonable terms as provided for by the terms of Contract No. F33615-02-C-5011 awarded by the United States Department of the Air Force. --

This certificate supersedes Certificate of Correction issued March 6, 2007.

Signed and Sealed this

Twenty-seventh Day of March, 2007

JON W. DUDAS
*Director of the United States Patent and Trademark Office*